US005542565A

United States Patent [19]

Hidalgo-Lopez

[11] Patent Number: 5,542,565

[45] Date of Patent: Aug. 6, 1996

[54] SOUP PLATE

[76] Inventor: Miguel A. Hidalgo-Lopez, 40 River Rd. #4G, New York, N.Y. 10044

[21] Appl. No.: 497,869

[22] Filed: Jul. 3, 1995

[51] Int. Cl.[6] ..... A47G 19/02; B65D 8/12

[52] U.S. Cl. ..... 220/574.1; 220/574; 220/675

[58] Field of Search ..... 220/574, 574.1, 220/575, 675

[56] References Cited

U.S. PATENT DOCUMENTS

| | | | |
|---|---|---|---|
| Re. 24,575 | 12/1958 | Costanzo | 220/574 |
| 231,034 | 8/1880 | Goessling | 220/575 |
| 766,427 | 8/1904 | Crowell | 220/575 |
| 1,220,495 | 3/1917 | Cadby | 220/574 |
| 1,272,996 | 7/1918 | Poschadel | 220/575 |
| 4,986,434 | 1/1991 | Prestyly, Jr. | 220/574 |

FOREIGN PATENT DOCUMENTS

| | | | |
|---|---|---|---|
| 0001815 | 2/1886 | United Kingdom | 220/575 |
| 0001483 | of 1888 | United Kingdom | 220/575 |
| 0023109 | 1/1894 | United Kingdom | 220/574 |
| 0024619 | 11/1906 | United Kingdom | 220/83 |

*Primary Examiner*—Allan N. Shoap
*Assistant Examiner*—Niki M. Kopsidas

[57] ABSTRACT

A soup plate comprised of a plate having an open circular top end, a closed circular lower end, and an intermediate side wall therebetween. The intermediate side wall slopes inwardly from the open circular top towards the closed circular lower end. The closed circular lower end slopes slightly downwardly towards a front portion thereof. The front portion of the closed circular lower end has an oval reservoir formed therein.

2 Claims, 2 Drawing Sheets

SOUP PLATE

BACKGROUND OF THE INVENTION

1. Field of the Invention

The present invention relates to a soup plate and more particularly pertains to providing a soup plate that does not need to be tipped in order to retrieve any remaining soup from its bottom.

2. Description of the Prior Art

The use of soup bowls is known in the prior art. More specifically, soup bowls heretofore devised and utilized for the purpose of containing soup are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,172,826 to Celaya discloses a food bowl.

U.S. Pat. No. Des. 265,157 to McKeegan discloses the ornamental design for a soup bowl.

U.S. Pat. No. Des. 288,048 to Unger discloses the ornamental design for a soup bowl or other similar article.

U.S. Pat. No. Des. 288,051 to Unger discloses the ornamental design for a soup bowl or other similar article.

U.S. Pat. No. Des. 290,076 to Unger discloses the ornamental design for a soup bowl or other similar article.

While these devices fulfill their respective, particular objective and requirements, the aforementioned patents do not describe a soup plate for providing a soup plate that does not need to be tipped in order to retrieve any remaining soup from its bottom.

In this respect, the soup plate according to the present invention substantially departs from the conventional concepts and designs of the prior art, and in doing so provides an apparatus primarily developed for the purpose of providing a soup plate that does not need to be tipped in order to retrieve any remaining soup from its bottom.

Therefore, it can be appreciated that there exists a continuing need for new and improved soup plate which can be used for providing a soup plate that does not need to be tipped in order to retrieve any remaining soup from its bottom. In this regard, the present invention substantially fulfills this need.

SUMMARY OF THE INVENTION

In the view of the foregoing disadvantages inherent in the known types of soup bowls now present in the prior art, the present invention provides an improved soup plate. As such, the general purpose of the present invention, which will be described subsequently in greater detail, is to provide a new and improved soup plate and method which has all the advantages of the prior art and none of the disadvantages.

To attain this, the present invention essentially comprises a plate having an open circular top end, a closed circular lower end, an intermediate side wall therebetween, an interior surface, and an exterior surface. The intermediate side wall slopes inwardly from the open circular top towards the closed circular lower end. The open circular top has a rim integral with an outer periphery thereof. The interior surface of the closed circular lower end slopes slightly downwardly towards a front portion thereof. The front portion of the closed circular lower end has an oval reservoir formed therein. The oval reservoir assumes about one-third the surface area of the interior surface of the closed circular lower end. The oval reservoir has a concave lower surface. The oval reservoir has two flat projections extending inwardly from opposing ends thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved soup plate which has all the advantages of the prior art soup bowls and none of the disadvantages.

It is another object of the present invention to provide a new and improved soup plate which may be easily and efficiently manufactured and marketed.

It is a further object of the present invention to provide a new and improved soup plate which is of durable and reliable construction.

An even further object of the present invention is to provide a new and improved soup plate which is susceptible of a low cost of manufacture with regard to both materials and labor, and which accordingly is then susceptible of low prices of sale to the consuming public, thereby making such a soup plate economically available to the buying public.

Still yet another object of the present invention is to provide a new and improved soup plate which provides in the apparatuses and methods of the prior art some of the advantages thereof, while simultaneously overcoming some of the disadvantages normally associated therewith.

Even still another object of the present invention is to provide a new and improved soup plate for providing a soup plate that does not need to be tipped in order to retrieve any remaining soup from its bottom with a soup plate.

Lastly, it is an object of the present invention to provide a new and improved soup plate comprised of a plate having an open circular top end, a closed circular lower end, and an intermediate side wall therebetween. The intermediate side wall slopes inwardly from the open circular top towards the closed circular lower end. The closed circular lower end slopes slightly downwardly towards a front portion thereof. The front portion of the closed circular lower end has an oval reservoir formed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
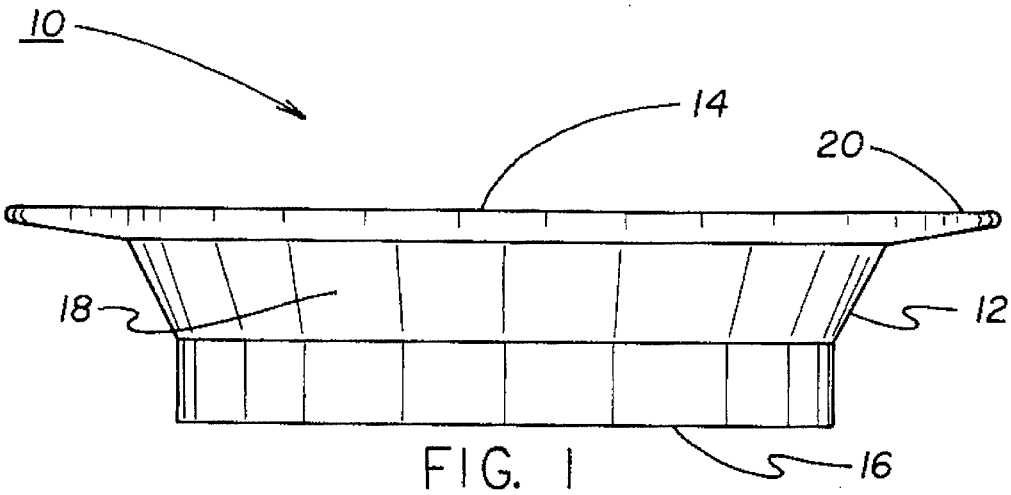
FIG. 1 is a side view of the preferred embodiment of the soup plate constructed in accordance with the principles of the present invention.
Figure 2:
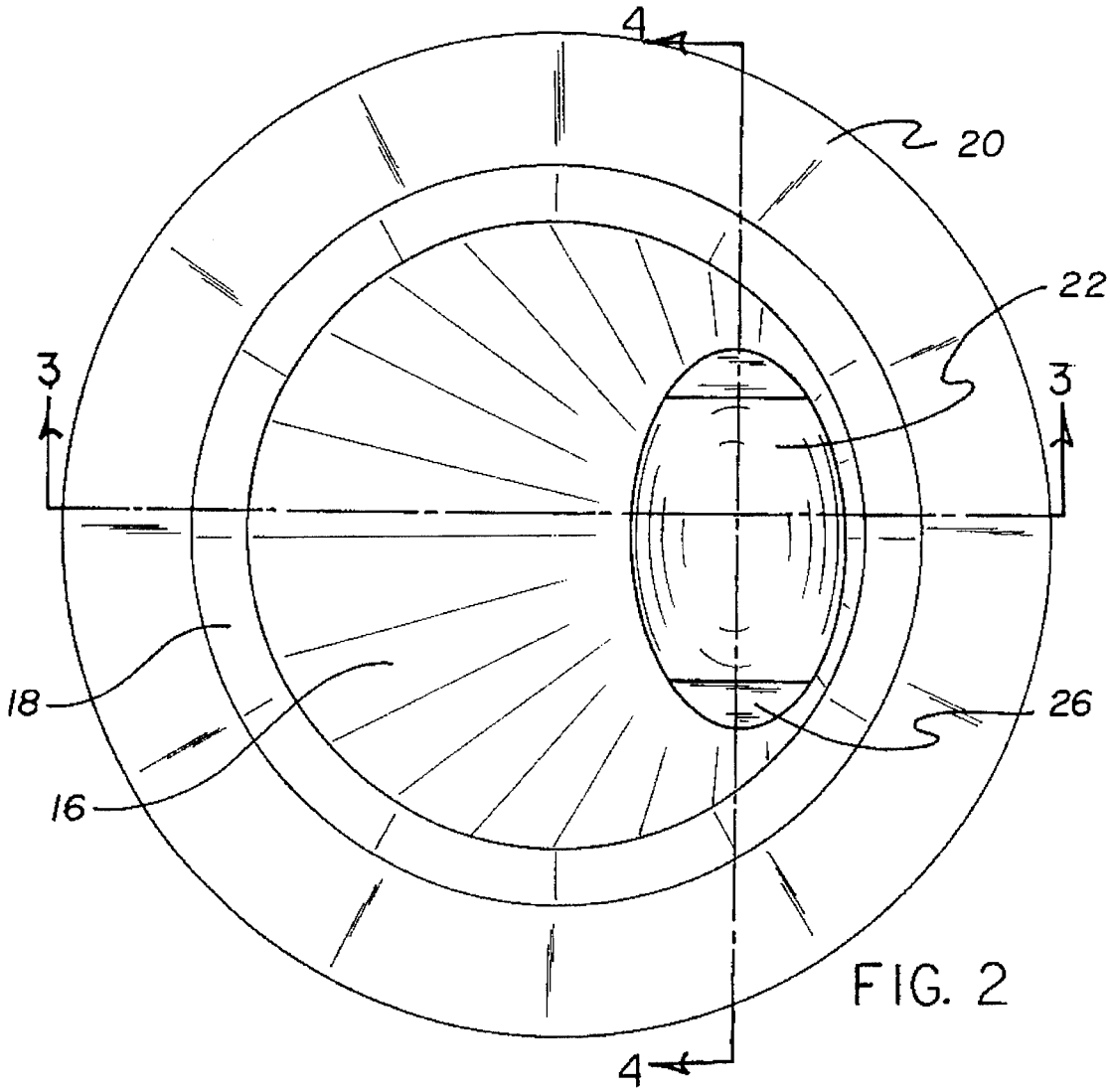
FIG. 2 is a plan view of the preferred embodiment of the present invention.
Figure 3:
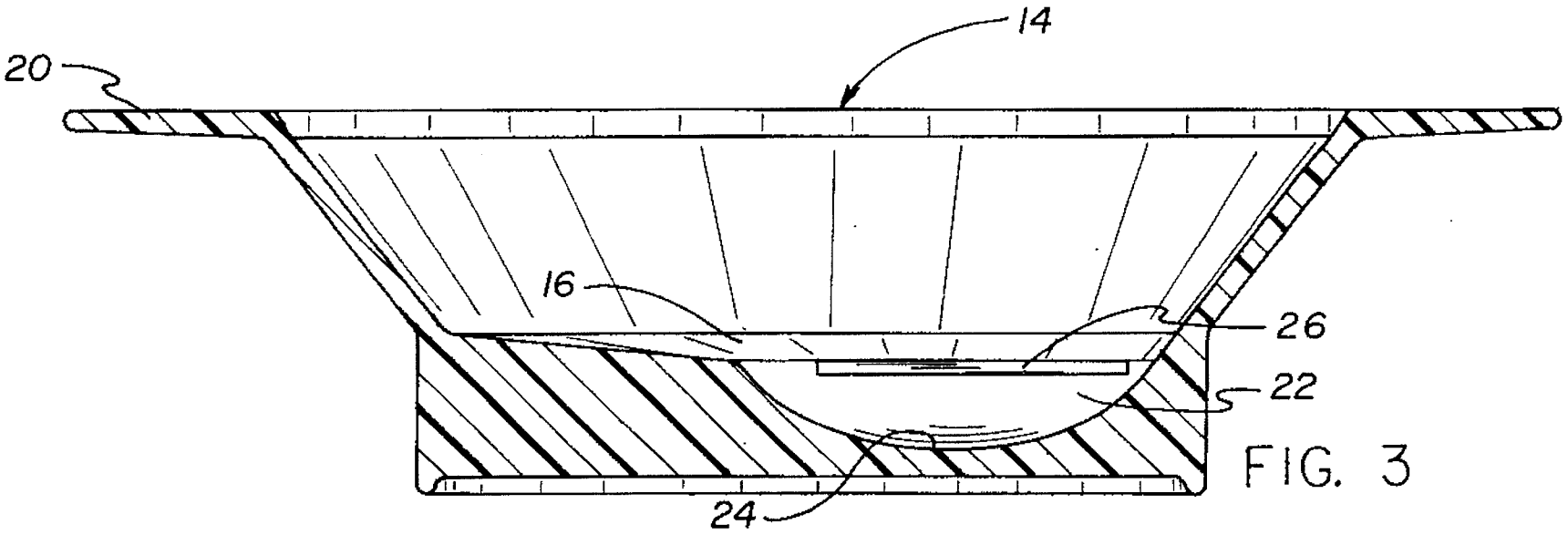
FIG. 3 is a cross-sectional view as taken along line 3—3 of FIG. 2.
Figure 4:
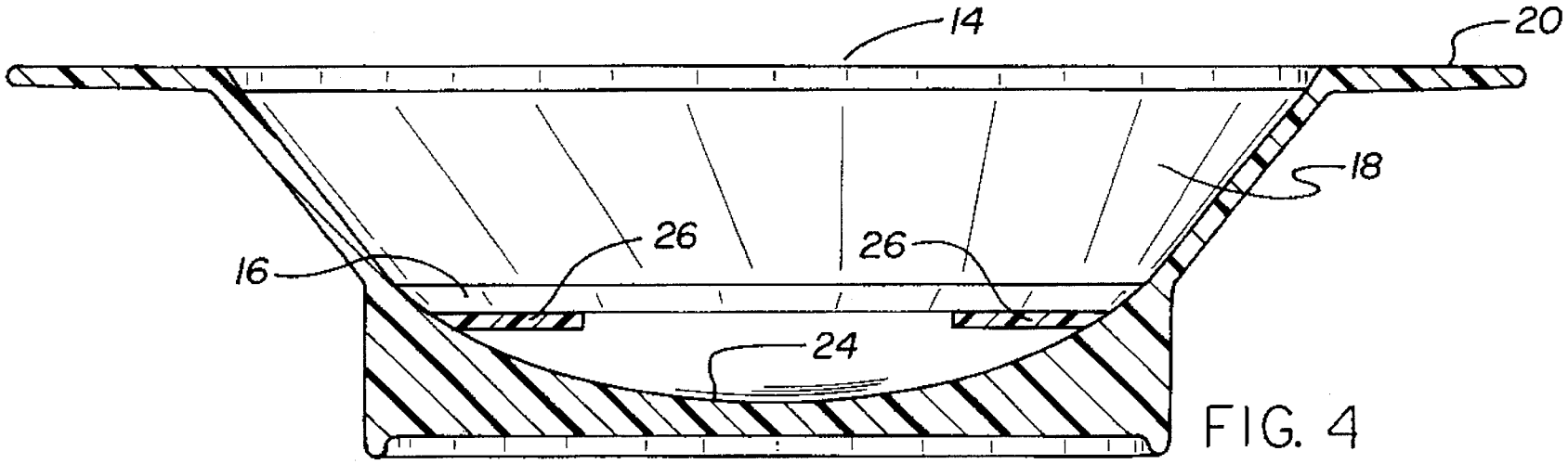
FIG. 4 is a cross-sectional view as taken along line 4—4 of FIG. 2.

With reference now to the drawings, and in particular, to FIGS. 1–4 thereof, the preferred embodiment of the new and improved soup plate embodying the principles and concepts of the present invention and generally designated by the reference number 10 will be described.

Specifically, it will be noted in the various Figures that the device relates to a soup plate for providing a soup plate that does not need to be tipped in order to retrieve any remaining soup from its bottom with a soup plate. In its broadest context, the device consists of a plate.

The main component of the device 10 is a plate 12 having an open circular top end 14, a closed circular lower end 16, an intermediate side wall 18 therebetween, an interior surface, and an exterior surface. The intermediate side wall 18 slopes inwardly from the open circular top 14 towards the closed circular lower end 16. The open circular top 14 has a rim 20 integral with an outer periphery thereof. The interior surface of the closed circular lower end 16 slopes slightly downwardly towards a front portion thereof. The front portion of the closed circular lower end 16 has an oval reservoir 22 formed therein. The oval reservoir 22 assumes about one-third the surface area of the interior surface of the closed circular lower end 16. The oval reservoir 22 has a concave lower surface 24. The oval reservoir 22 has two flat projections 26 extending inwardly from opposing ends thereof. The two flat projections are utilized to either hold a user's spoon or provide a means to scrape chunks of food off of their spoon. The device 10 is used by filling the plate 12 with soup. A person eats the soup as one normally would do. However, once the level of the soup becomes relatively low, the remaining soup will gather in the oval reservoir 22 allowing the person to eat the soup without having to tip the plate 12 forward in order to be able to spoon out the remaining soup. The plate 12 could be designed in any number of sizes and the size of the oval reservoir 22 could also be made to be larger or smaller than previously noted. The oval reservoir 22 shape is a design preference, a circle or other shape could be also be successfully employed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A soup plate for providing a soup plate that does not need to be tipped in order to retrieve any remaining soup from its bottom with a soup plate comprising, in combination:

a plate having an open circular top end, a closed circular lower end, an intermediate side wall therebetween, the plate further having an interior surface, and an exterior surface, the intermediate side wall sloping inwardly from the open circular top towards the closed circular lower end, the open circular top having a rim integral with an outer periphery thereof, the interior surface of the closed circular lower end sloping slightly downwardly towards a front portion thereof, the front portion of the closed circular lower end having an oval reservoir formed therein, the oval reservoir assuming about one-third the surface area of the interior surface of the closed circular lower end, the oval reservoir having a concave lower surface, the oval reservoir having two flat projections extending inwardly from opposing ends thereof.

2. A soup plate for providing a soup plate that does not need to be tipped in order to retrieve any remaining soup from its bottom comprising, in combination:

a plate having an open circular top end, a closed circular lower end, and an intermediate side wall therebetween, the intermediate side wall sloping inwardly from the open circular top towards the closed circular lower end, the closed circular lower end sloping slightly downwardly towards a front portion thereof, the front portion of the closed circular lower end having an oval reservoir formed therein with two flat projections extending inwardly from opposing ends of the oval reservoir of the plate, the oval reservoir assuming about one-third the surface area of the closed circular lower end, and the plate further including a rim integral with an outer periphery of the open circular top of the plate.

* * * * *